US010844665B2

(12) United States Patent
Jones et al.

(10) Patent No.: US 10,844,665 B2
(45) Date of Patent: Nov. 24, 2020

(54) WIRED MOTOR FOR REALTIME DATA

(71) Applicant: SANVEAN TECHNOLOGIES LLC, Katy, TX (US)

(72) Inventors: Stephen Jones, Cypress, TX (US); Junichi Sugiura, Bristol (GB)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 17 days.

(21) Appl. No.: 16/422,500

(22) Filed: May 24, 2019

(65) Prior Publication Data

US 2019/0277091 A1 Sep. 12, 2019

Related U.S. Application Data

(63) Continuation-in-part of application No. 15/800,825, filed on Nov. 1, 2017, now Pat. No. 10,337,319.

(60) Provisional application No. 62/418,495, filed on Nov. 7, 2016.

(51) Int. Cl.

| | |
|---|---|
| ***E21B 4/02*** | (2006.01) |
| ***E21B 47/12*** | (2012.01) |
| ***E21B 7/04*** | (2006.01) |
| ***E21B 47/024*** | (2006.01) |
| ***E21B 49/00*** | (2006.01) |
| *E21B 7/06* | (2006.01) |
| *E21B 47/06* | (2012.01) |
| *E21B 47/07* | (2012.01) |

(52) U.S. Cl.

CPC ..... *E21B 7/04* (2013.01); *E21B 4/02* (2013.01); *E21B 47/024* (2013.01); *E21B 49/00* (2013.01); *E21B 7/067* (2013.01); *E21B 47/06* (2013.01); *E21B 47/07* (2020.05); *E21B 47/12* (2013.01)

(58) Field of Classification Search

CPC ..... E21B 4/02

See application file for complete search history.

(56) References Cited

U.S. PATENT DOCUMENTS

| | | | | |
|---|---|---|---|---|
| 5,725,061 | A * | 3/1998 | Van Steenwyk | E21B 4/02 175/104 |
| 2007/0079988 | A1* | 4/2007 | Konschuh | E21B 47/13 175/40 |
| 2009/0205869 | A1* | 8/2009 | Prill | E21B 4/02 175/40 |
| 2010/0187009 | A1* | 7/2010 | Siher | E21B 4/006 175/57 |
| 2013/0228381 | A1* | 9/2013 | Yambao | E21B 47/01 175/107 |
| 2015/0292280 | A1* | 10/2015 | Lewis | E21B 21/103 175/25 |

* cited by examiner

*Primary Examiner* — Giovanna Wright

(74) *Attorney, Agent, or Firm* — Adolph Locklar

(57) ABSTRACT

A bottomhole assembly may include a downhole motor and bearing assembly. The downhole motor may include a rotor and stator. The bearing assembly may include a bearing mandrel. The bearing mandrel may be coupled to the rotor by a transmission shaft. The bottomhole assembly may include one or more sensors positioned in the bearing mandrel, transmission shaft, or rotor. The bottomhole assembly may include a conductor that passes through one or more of the bearing mandrel, transmission shaft, and the rotor from the sensor to a communications package.

20 Claims, 8 Drawing Sheets

WIRED MOTOR FOR REALTIME DATA

CROSS-REFERENCE TO RELATED APPLICATIONS

This application is a continuation in part of U.S. application Ser. No. 15/800,825, filed Nov. 1, 2017, and claims priority from U.S. provisional application No. 62/418,495, filed Nov. 7, 2016.

TECHNICAL FIELD/FIELD OF THE DISCLOSURE

The present disclosure relates generally to downhole motors, and specifically to wired communication in downhole motors.

BACKGROUND OF THE DISCLOSURE

When drilling a wellbore, it may be desirable to measure one or more parameters from within the wellbore near the drill bit. Traditionally, one or more sensors are positioned in a near-bit sub positioned between the drill bit and the rest of the downhole assembly. However, the near-bit sub may add length to the lower end of the downhole motor and may therefore reduce the ability of the downhole assembly to be steered by, for example and without limitation, a bent sub or bent housing. Typically, sensors in the near-bit sub use a wireless connection to transmit information to a measurement while drilling assembly positioned above the downhole motor. However, the use of electromagnetic transmission across the mud motor may require a large amount of power, necessitating the use of batteries and special antennae, which may increase the cost and reliability of the downhole assembly.

SUMMARY

The present disclosure provides for a method. The method may include providing a bottomhole assembly. The bottomhole assembly may include a downhole motor, the downhole motor including a rotor and a stator, the rotor having a first end and a second end. The bottomhole assembly may include a bearing assembly, the bearing assembly including a bearing housing and a bearing mandrel, the bearing mandrel having a first end and a second end. The bottomhole assembly may include a transmission shaft having a first end and a second end. The first end of the transmission shaft may be mechanically coupled to the first end of the rotor. The second end of the transmission shaft may be mechanically coupled to the first end of the bearing mandrel. The bottomhole assembly may include a sensor positioned at the second end of the transmission shaft. The bottomhole assembly may include a conductor positioned within the transmission shaft and the rotor, the conductor extending from the sensor to the second end of the rotor. The bottomhole assembly may include a communications package positioned at the second end of the rotor. The method may include positioning the bottomhole assembly on a drill string, positioning the bottomhole assembly in a wellbore, taking a measurement with the sensor, and transmitting the measurement from the sensor to the communications package through the transmission shaft and the rotor using the conductor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
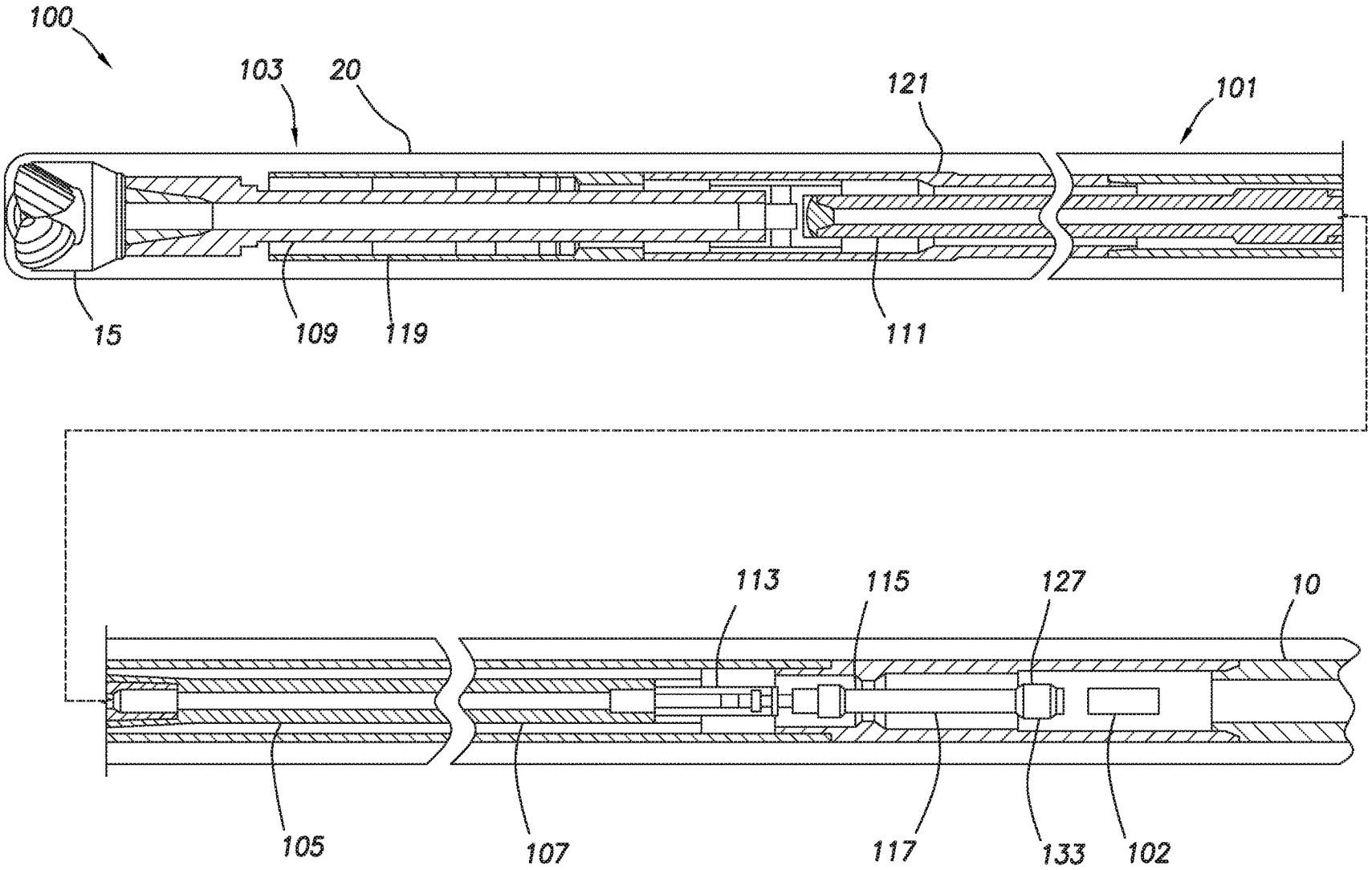
FIG. 1 depicts a cross section view of a bottomhole assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts bottomhole assembly (BHA) 100. BHA 100 may be mechanically coupled to drill string 10. BHA 100 may include downhole motor 101, which may be used to rotate drill bit 15 during the drilling of wellbore 20. In some embodiments, downhole motor 101 may be a positive displacement progressing cavity motor with external bend or internal tilted mandrel. In some embodiments, downhole motor 101 may be a turbine or gear reduced turbine motor. In some embodiments, BHA 100 may include one or more downhole electronics packages including, for example and without limitation, measurement while drilling (MWD) assembly 102.

In some embodiments, BHA 100 may include bearing assembly 103. Downhole motor 101 may be used to rotate one or more components of BHA 100 in order to rotate drill bit 15. Downhole motor 101 may include rotor 105 and stator 107. Rotor 105 may be positioned within stator 107 and may rotate relative to stator 107 in response to the flow of drilling fluid through stator 107. In some embodiments, rotating components of BHA 100 may include, without limitation, drill bit 15, bearing mandrel 109, transmission shaft 111, rotor catch shaft 113, flex shaft 115, and one or more components of communication package 117.

In some embodiments, bearing mandrel 109 may be positioned within bearing housing 119 in order to form bearing assembly 103. In some embodiments, bearing housing 119 may mechanically couple to stator 107. In some embodiments, bearing housing 119 may mechanically couple to stator 107 through bent housing 121. In such an embodiment, bent housing 121 may be configured such that bearing housing 119 extends at an angle to stator 107 allowing, for example and without limitation, a wellbore formed using BHA 100 to be steered or otherwise drilled at an angle.

Figure 2:
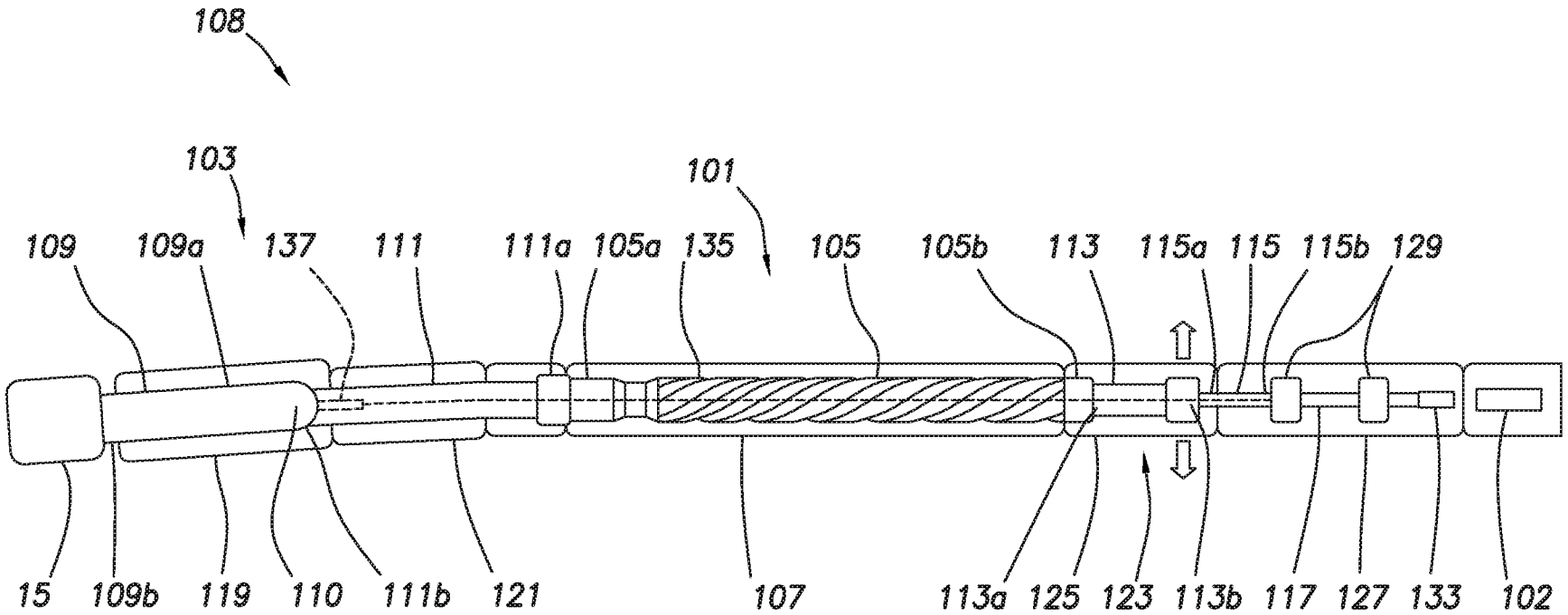
FIG. 2 depicts a cross section view of a bottomhole assembly consistent with at least one embodiment of the present disclosure.
Figure 3:
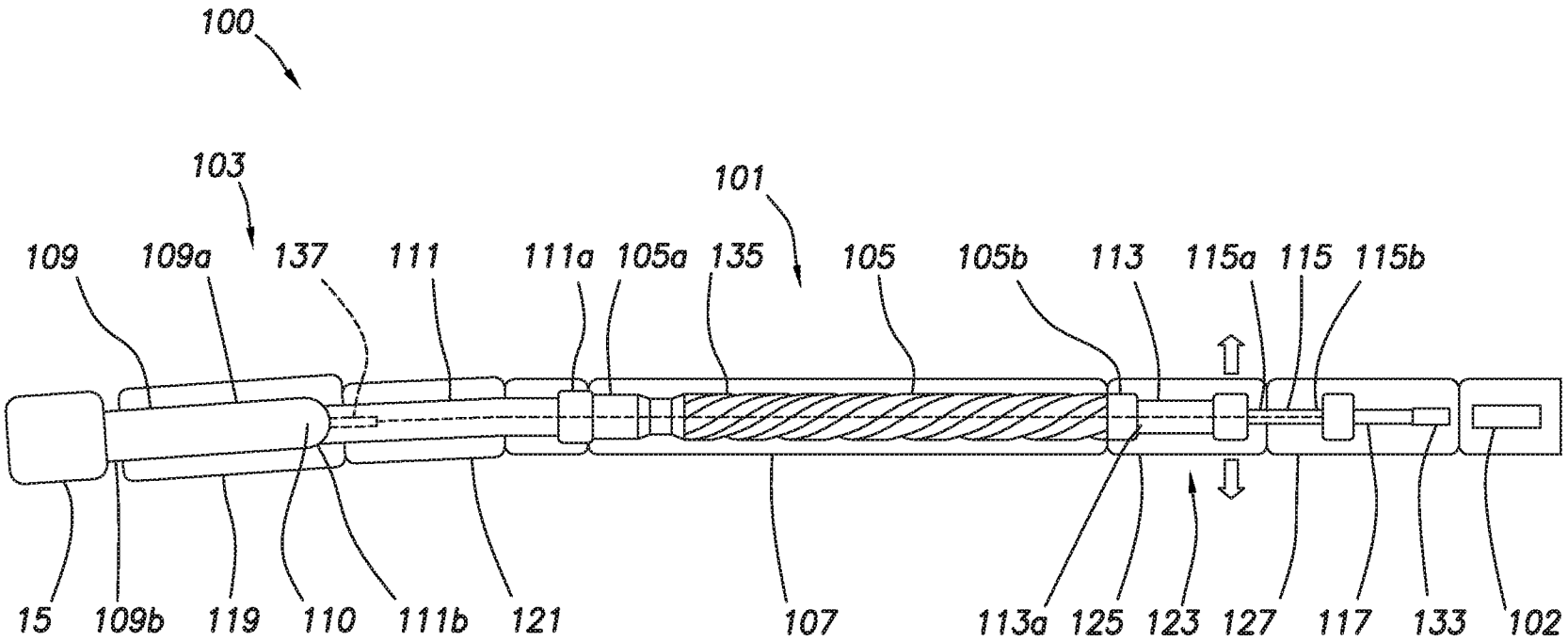
FIG. 3 depicts a cross section view of a bottomhole assembly consistent with at least one embodiment of the present disclosure.

In some embodiments, as depicted in FIGS. 2, 3, a first end 111*a* of transmission shaft 111 may be mechanically coupled to a first end 105*a* of rotor 105 and the second end 111*b* of transmission shaft 111 may be mechanically coupled to bearing mandrel 109. In such an embodiment, transmission shaft 111 may mechanically couple rotor 105 with bearing mandrel 109, thereby coupling eccentric rotation of rotor 105 within stator 107 to concentric rotation of bearing mandrel 109. In some embodiments, transmission shaft 111 may be a single-articulated transmission shaft. In some such embodiments, transmission shaft 111 may be rigidly coupled to rotor 105 and may couple to bearing mandrel 109 through universal joint 110. In other embodiments, transmission shaft 111 may be rigidly coupled to both bearing mandrel 109 and rotor 105 and may be formed from a flexible material. Drill bit 15 may be mechanically coupled to the second end 109*b* of bearing mandrel 109.

In some embodiments, BHA 100 may include rotor catch assembly 123. Rotor catch assembly 123 may include top sub 125 also known as a rotor catch housing and rotor catch shaft 113. Rotor catch shaft 113 may mechanically couple at a first end 113*a* to the second end 105*b* of rotor 105. Rotor catch assembly 123 may, for example and without limitation, retain rotor 105 within stator 107 in the case of a mechanical failure of one or more components of BHA 100.

In some embodiments, second end 113*b* of rotor catch shaft 113 may mechanically couple to a first end 115*a* of flex shaft 115. Flex shaft 115 may mechanically couple at its second end 115*b* to communications package 117. In some embodiments, second end 113*b* of rotor catch shaft 113 may mechanically couple to communications package 117 directly, without using a flex shaft 115 or a bearing. In some embodiments, communications package 117 may include one or more of batteries, electronics, collectors, and coil transceivers as further discussed herein below. As used herein, "coil transceiver" is not intended to require capability of both transmission and reception, and may include one or both of a transmitter and receiver. In some embodiments, flex shaft 115 may mechanically couple the eccentric rotary motion of rotor 105 and concentric rotation of one or more components of communications package 117.

In some embodiments, one or more components of communications package 117 and MWD assembly 102 may be positioned within MWD sub housing 127. MWD sub housing 127 may be mechanically coupled to top sub 125.

In some embodiments, as depicted in FIG. 2, communications package 117 may be mechanically coupled to MWD sub housing 127 by one or more radial bearings 129. Radial bearings 129 may, for example and without limitation, allow concentric rotation of communications package 117.

In some embodiments, as depicted in FIG. 3, communications package 117 may include flow diverter 131. Flow diverter 131 may include a rotating portion mechanically coupled to flex shaft 115 and a nonrotating portion mechanically coupled to MWD sub housing 127. In such an embodiment, flow diverter 131 may allow for rotation between the rotating portion and nonrotating portion while allowing electrical continuity for one or more electrical connections passing therethrough and to communications package 117. In some embodiments, flow diverter 131 may include an inductive collector allowing at least part of communications package 117 to be nonrotating relative to MWD sub housing 127. In some such embodiments, MWD assembly 102 may be directly coupled to communications package 117.

In some embodiments, as depicted in FIGS. 2, 3, communications package 117 may include coil transceiver 133. Coil transceiver 133 may include a coil used to transmit, receive, or transmit and receive one or more of data and power between communications package 117 and a coil positioned in MWD assembly 102. Coil transceiver 133 may communicate data or power with MWD assembly 102 via uni-directional or bi-directional wireless communications. In some embodiments, such as those depicted in FIG. 2, coil transceiver 133 may rotate relative to MWD sub housing 127. In some embodiments, such as those depicted in FIG. 3, coil transceiver 133 may be stationary relative to MWD sub housing 127.

Figure 6:
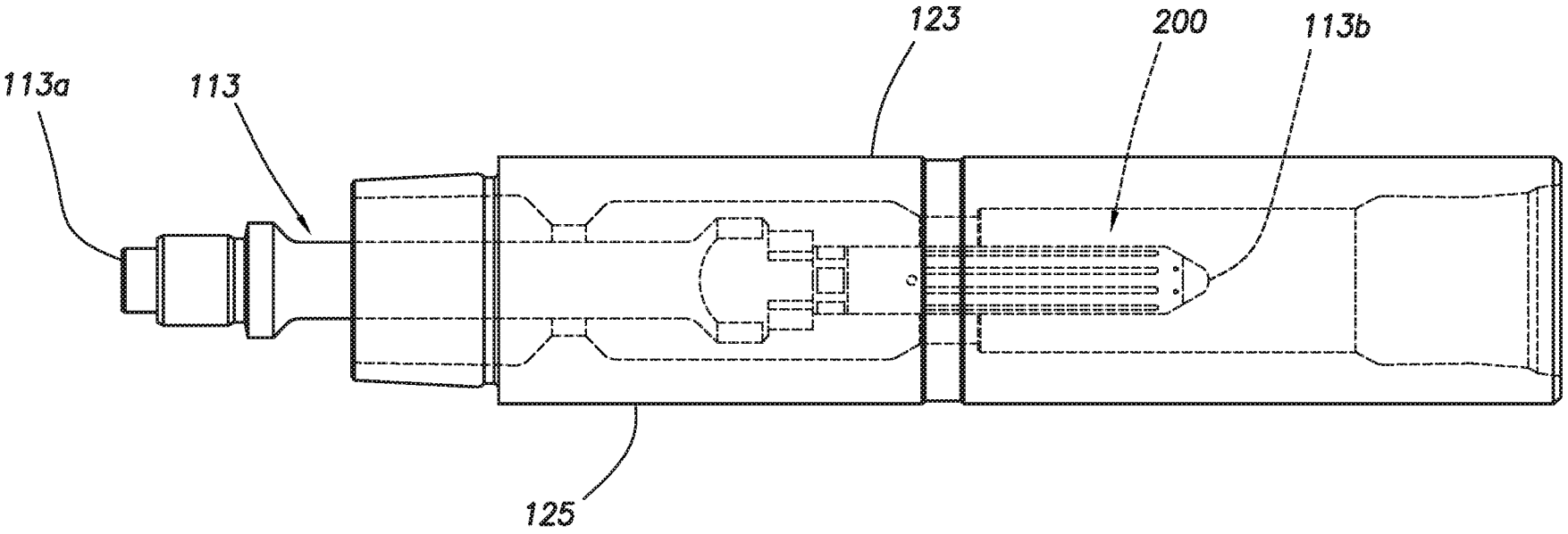
FIG. 6 is a cross section view of a portion of a bottomhole assembly consistent with at least one embodiment of the present disclosure.
Figure 7:
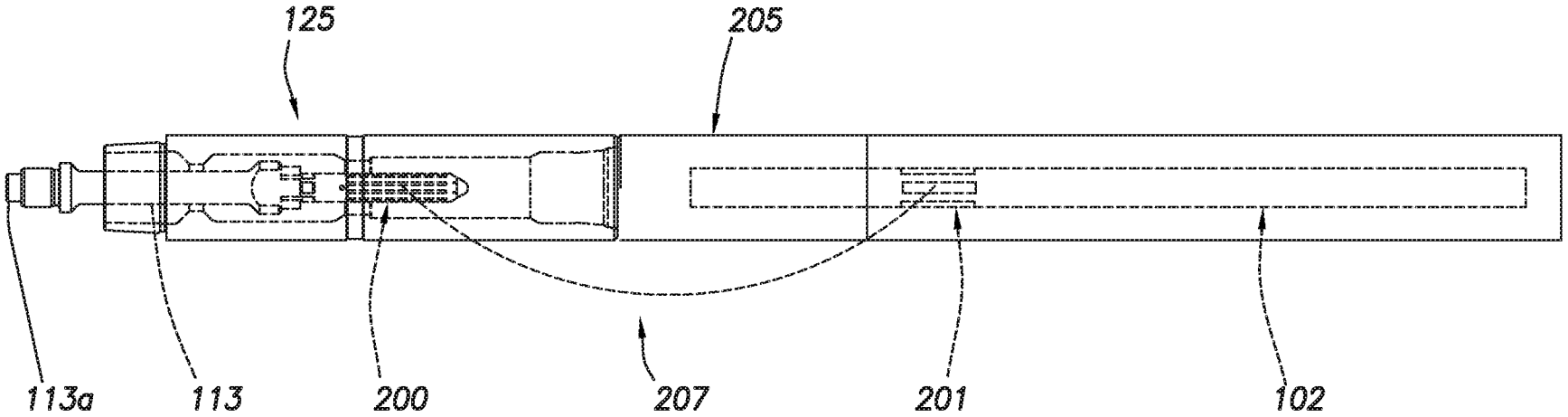
FIG. 7 is a cross section view of a portion of a bottomhole assembly consistent with at least one embodiment of the present disclosure.

In other embodiments, as depicted in FIGS. 6, 7, BHA 100 does not include flex shaft 115. Rotor catch assembly 123 is depicted in FIG. 6. Rotor catch shaft 113 may include, at or near second end 113*b* of rotor catch shaft 113, transmission coil 200. Transmission coil 200 may be positioned within rotor catch shaft 113. As shown in FIG. 7, transmission coil 200 may be part of a short-hop communication system. Transmission coil 200 may transmit data along short hop communications path 207 to receiver coil 201. Receiver coil 201 may be positioned within MWD assembly 102. In certain embodiments of the present disclosure, as shown in FIG. 7, rotor catch assembly 123 may be connected to MWD assembly 102 through Universal Bottom Hole Orientation Sub (UBHO sub) 205.

In some embodiments, as depicted in FIGS. 2, 3, BHA 100 may include one or more conductors 135. Conductors 135 may be positioned within and extend through one or more components of BHA 100 from communications package 117 to sensor 137 positioned within BHA 100. In some embodiments, sensor 137 may be positioned at or near second end 111*b* of transmission shaft 111 at a location proximate bearing assembly 103. In some embodiments, sensor 137 may include one or more of a low-g accelerometer, a high-g accelerometer, a temperature sensor, a solid-state gyro, gyroscope, a Hall-effect sensor, a magnetometer, a strain gauge, a pressure transducer or a combination thereof. As used herein, low-g accelerometers may measure up to, for example and without limitation, between +/−16 G. As used herein, high-g accelerometers may measure up to, for example and without limitation, between +/−500 G. As used herein, solid-state gyros, low-g accelerometers and high-g accelerometers may be sampled and continuously recorded up to, for example, 4000 Hz. In some embodiments, rotation speed in RPM (revolutions per minute) may be measured by gyroscopes, for example and without limitation, between 0 and 800 RPM. Temperature may be measured, for example and without limitation, between −40° C. and 175° C. In some embodiments, conductors 135 may allow for electric connection and communication of one or more of power and data connectivity between communications package 117 and sensor 137 in either unidirectional or bi-directional communications. In some embodiments, conductors 135 may extend from communications package 117 through flex shaft 115, rotor 105, and transmission shaft 111. In some embodiments, for example where transmission shaft 111 is rigidly coupled to bearing mandrel 109, conductors 135 may extend at least partially through bearing mandrel 109.

Figure 4:
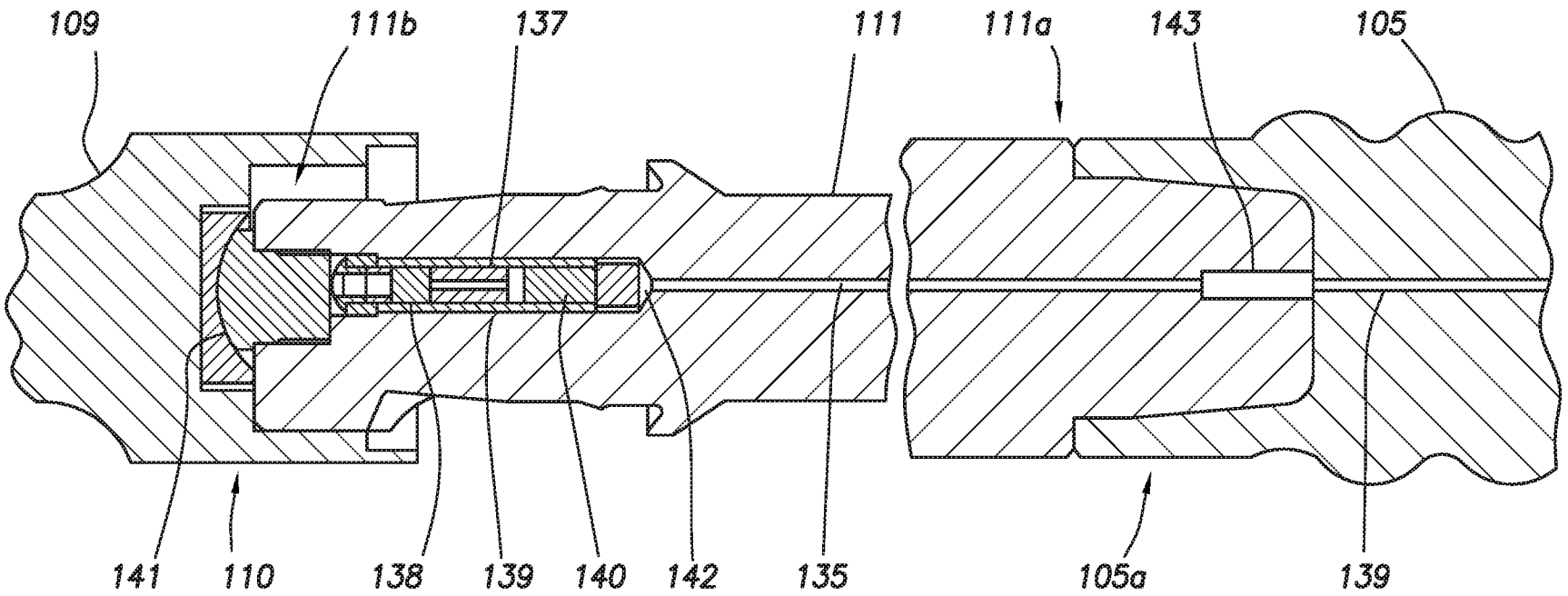
FIG. 4 depicts a cross section view of a transmission shaft consistent with at least one embodiment of the present disclosure.

In some embodiments, as depicted in FIG. 4, sensor 137 may be positioned in sensor pocket 139 formed at second end 111*b* of transmission shaft 111. In other embodiments, sensor pocket 139 may be formed at first end 111*a* of transmission shaft 111, at first end 105*a* or second end 105*b* of rotor 105, at first end 109*a* or second end 109*b* of bearing mandrel 109, or anywhere in between. In some embodiments in which transmission shaft 111 is formed from a flexible material as discussed herein above, conductors 135 may extend through bearing mandrel 109 and to first end 109*a* or second end 109*b* of bearing mandrel 109. In some embodiments, multiple sensor pockets 139 may be positioned throughout BHA 100. In such an embodiment, sensors 137 may be used to, for example, gather a gradient of the information (e.g. temperature). In some such embodiments, information gathered by sensors 137 positioned in each sensor pocket 139 may be used together to determine information about the operation of BHA 100 including, for example and without limitation, temperature difference across downhole motor 101, temperature gradient of rotor 105, drilling dysfunction and drilling efficiency of drill bit 15, etc.

Figure 8:
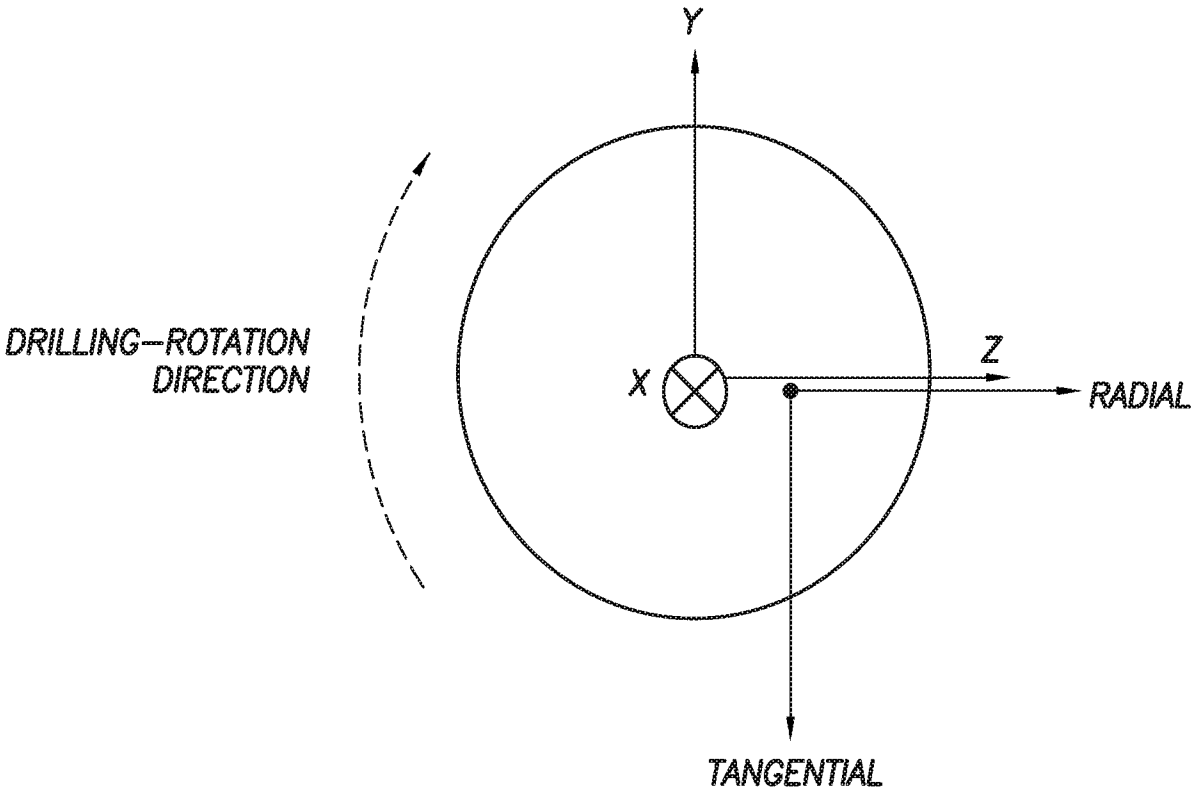
FIG. 8 is a diagram depicting determination of HFTO consistent with certain embodiments of the present disclosure.

In some embodiments, information about the operation of BHA 100 may be transmitted to the surface via mud pulse telemetry. In some embodiments, temperature difference, temperature gradient, and other drilling dynamics information may be classified into different severity levels, for example, 4 to 8 severity levels indicative of a measured condition. As a non-limiting example, in embodiments in which 2-bit severity levels (4 levels) are used, a temperature difference may be coded as Level 1 which may be between 0 and 2 degrees centigrade, Level 2 between 2 and 4 degrees centigrade, Level 3 between 4 and 6 degrees centigrade, and Level 4 above 6 degrees centigrade. Similarly, downhole acceleration events or shocks may be coded as Level 1 (no shock) between 0 and 10 g, Level 2 (low) between 10 and 40 g, Level 3 (medium) between 40 and 100 g, and Level 4 (high) above 100 g. As another example, high-frequency torsional oscillation (HFTO) may be detected with tangential acceleration measurement or angular gyro measurement with an expected frequency range, for example, between 100 and 800 Hz. By applying a digital band-pass, analog band-pass, high-pass filter, digital high-pass filter, analog high-pass filter, or a combination thereof to filter readings from a tangential accelerometer or gyro, downhole HFTO events may be coded as Level 1 (no HFTO) between 0 and 10 g, Level 2 (low HFTO) between 10 and 40 g, Level 3 (medium HFTO) between 40 and 100 g, and Level 4 (high HFTO) above 100 g. FIG. 8 is a diagram depicting determination of HFTO consistent with certain embodiments of the present disclosure.

Rock mechanics parameters (e.g. Young's modulus, Poisson's ratio, compressive strength, and Fractures), also known as geomechanical parameters, may be detected with tri-axial high-frequency acceleration measurement with an expected frequency range, for example, between 100 and 1000 Hz, as described, for example in SPWLA 2017—"A Novel Technique for Measuring (Not Calculating) Young's Modulus, Poisson's Ratio and Fractures Downhole: A Bakken Case Study". By applying a digital band-pass, analog band-pass, digital high-pass filters, analog high-pass filters, or a combination thereof on the at least one accelerometer, downhole fractures may be coded as Level 1 (no fractures) between 0 and 10, Level 2 (low) between 10 and 40, Level 3 (medium) between 40 and 100, and Level 4 (high) above 100 (the numbers are without units, but correlated to the number of fractures).

With a limited mud pulse telemetry bandwidth, severity level classification may operate as a data compression method. In some embodiments, sensor pocket 139 may be formed at second end 111*b* of transmission shaft 111 behind one or more components of universal joint 110 such as thrust cap 141. In some embodiments, sensor pocket 139 may include, for example and without limitation, sensor 137, battery 138, electronics 140, and connector 142 for connecting one or more of sensor 137, battery 138, and electronics 140 to conductor 135. In some embodiments, one or more sensors may be integrated into communications package 117. The integrated sensors may include solid-state gyros, low-g accelerometers, high-g accelerometers, and temperature sensors. The gyro sensors may be used to detect rotation on/off events with a simple RPM threshold, such as 10 RPM. The integrated gyro sensor may be used to decode rotation-speed-modulation downlinks by using, for example, the method disclosed in US Pat App. 20170254190, which is incorporated herein by reference. The low-g and high-g accelerometers may be used to calculate inclinations and detect inclination on/off events with a simple inclination threshold, such as 45 degrees. The low-g and high-g accelerometers may detect flow on/off event with a simple vibration threshold, such as +/−1 G peak accelerations and/or with a simple vibration variance threshold, such as +/−0.2 G accelerations.

In some embodiments, conductors 135 may be made up of multiple lengths of conductor, each length passing through one component of BHA 100. In some such embodiments, one or more connector assemblies 143 may be positioned between the adjacent components, such as connector assembly 143 positioned between first end 111*a* of transmission shaft 111 and first end 105*a* of rotor 105 as depicted in FIG. 4. In some embodiments, connector assemblies 143 may be positioned between one or more of transmission shaft 111 and rotor 105, between rotor 105 and flex shaft 115, between flex shaft 115 and communications package 117, or between any other mechanically connections. Connector assemblies 143 may, for example and without limitation, allow for disassembly of the components while ensuring electrical connectivity upon reassembly of the components.

Figure 5:
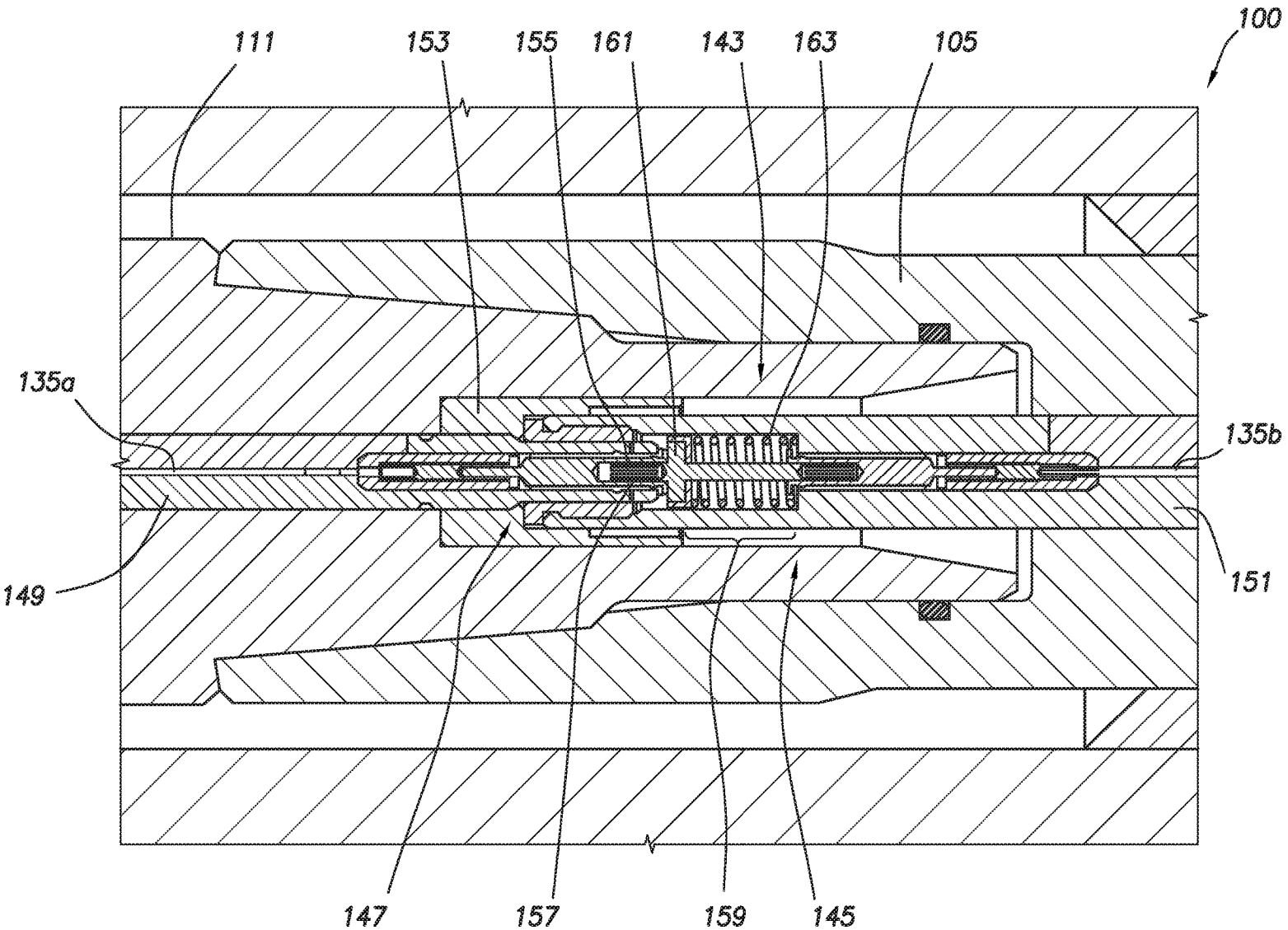
FIG. 5 depicts a cross section view of a connector consistent with at least one embodiment of the present disclosure.

In some embodiments, as depicted in FIG. 5, connector assembly 143 may include male connector 145 and female connector 147. FIG. 5 depicts female connector 147 as part of transmission shaft 111 and male connector 145. However, one having ordinary skill in the art with the benefit of this disclosure will understand that female connector 147 and male connector 145 may be positioned on any adjacent mechanically connected components including, for example and without limitation, bearing mandrel 109, transmission shaft 111, rotor 105, rotor catch shaft 113, flex shaft 115, and communications package 117. In some embodiments, female connector 147 may electrically couple to first conductor length 135*a* positioned in transmission shaft 111 and male connector 145 may electrically couple to second conductor length 135*b* positioned in rotor 105. In some embodiments, first conductor length 135*a* may be positioned within transmission conductor rod 149 within transmission shaft 111, and second conductor length 135*b* may be positioned within rotor conductor rod 151. In some embodiments, transmission conductor rod 149 may be mechanically coupled to tension nut 153 which may, in some embodiments, engage between transmission conductor rod 149 and transmission shaft 111 to place transmission conductor rod 149 under tension.

In some embodiments, male connector 145 may include plug 155 that, when male connector 145 is engaged with female connector 147, may enter and electrically couple with socket 157 formed in female connector 147. In some embodiments, plug 155 may be electrically coupled to second conductor length 135*b* through compression assembly 159. In some embodiments, compression assembly 159 may include pressure plate 161 mechanically and electrically coupled to plug 155 biased against rotor conductor rod 151 by spring 163. Spring 163 may, for example and without limitation, damp compressive forces between plug 155 and socket 157 as connector assembly 143 is made up, reducing the possibility of damage to BHA 100.

In some embodiments, conductors 135 may electrically couple sensor 137 with communications package 117. Communications package 117 may, in some embodiments, include a power supply for powering any electronics positioned therein and for providing power to sensor 137. The power supply may include, for example and without limitation, one or more batteries. In some embodiments, communications package 117 may transmit data from sensor 137 to MWD assembly 102 using coil transceiver 133 to wirelessly transmit the data to the corresponding coil positioned in MWD assembly 102. Communications package 117 may receive data from MWD assembly 102 to sensor 137 using coil transceiver 133. In such an embodiment, the communication may be full-duplex or semi-full duplex (bi-directional). The coil-to-coil distance between coil transceiver 133 and the coil of MWD assembly 102 may be between 1 inch and 10 feet. In some embodiments, the coil-to-coil communications may be achieved with inductive and/or capacitive coupling or electro-magnetic transmission/reception. The coil-to-coil communications frequency may be between 20 Hz and 200 MHz. Any known modulation techniques may be utilized for the coil-to-coil communications including, for example and without limitation, amplitude, frequency, and phase modulation. Conventional digital modulation schemes, for example, including QAM, DSL, ADSL, TDMA, FDMA, ASK, FSK, BPSK, QPSK and the like, may also be utilized. In some embodiments, MWD assembly 102 may include one or more transmitters/receivers for conveying information from sensors 137 including, for example and without limitation, one or more of mud pulse telemetry, EM (electro-magnetic) telemetry, acoustic telemetry, wired drill pipe, or a combination thereof (e.g. dual telemetry using both mud pulse and EM) or any other transmitter to the surface. In some embodiments that utilize bidirectional communication, on/off information from MWD assembly 102, such as for example and without limitation flow, pressure or vibration data, may be transmitted to sensor 137 and information such as inclination, gravity toolface, RPM, temperature, shock and vibration, HFTO, and rock mechanics (including, but not limited to Young's modulus, Poisson's ratio, compressive strength, and fractures) information from sensor 137 may be transmitted to MWD assembly 102. In some embodiments, information from sensor 137 such as an acceleration or velocity may be filtered by one or more of a digital band-pass, analog band-pass, digital high-pass, or analog high-pass filter may be transmitted to the surface. Such information may, for example and without limitation, be used to make a real-time drilling decision such as geo-steering. In some embodiments, downhole processed data including, for example and without limitation, geomechanics parameters such as rock parameters and pseudo LWD (logging-while-drilling) parameters, also referred to as formation-evaluation parameters, such as, for example and without limitation, Young's modulus, Poisson's ratio, shear modulus, confined compressive strength, unconfined compressive strength, pseudo sonic, pseudo porosity, pseudo Gamma, acceleration, velocity, inclination, gravity toolface, RPM, temperature, or shock and vibration may be derived from gyros, accelerometers, or a combination thereof and may be transmitted to the surface. Such information may, for example and without limitation, be used to make a real-time drilling decision, such as geo-steering. Although described above as transmitting to the surface, in some embodiments, transmissions may be made between tools positioned on drill string 10.

The configuration described herein may be advantageous for a cost-effective implementation of accurate, real-time, near-bit inclination measurement, but is not limited in this regard.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

providing a bottomhole assembly, the bottomhole assembly including:

a downhole motor, the downhole motor including a rotor and a stator, the rotor having a first end and a second end;

a bearing assembly, the bearing assembly including a bearing housing and a bearing mandrel, the bearing mandrel having a first end and a second end;

a transmission shaft having a first end and a second end, the first end of the transmission shaft mechanically coupled to the first end of the rotor, the second end of the transmission shaft mechanically coupled to the first end of the bearing mandrel;

a sensor positioned at the second end of the transmission shaft;

a conductor positioned within the transmission shaft and the rotor, the conductor extending from the sensor to the second end of the rotor; and a communications package, the communications package positioned at the second end of the rotor;

positioning the bottomhole assembly on a drill string;

positioning the bottomhole assembly in a wellbore;

taking a measurement with the sensor; and transmitting the measurement from the sensor to the communications package through the transmission shaft and the rotor using the conductor.

2. The method of claim 1, wherein the communications package further comprises a transceiver coil, and wherein the method further comprises transmitting the measurement from the sensor using the transceiver coil of the communications package.

3. The method of claim 2, further comprising receiving the measurement from the sensor transmitted by the communications package with the transceiver coil with a coil of a measurement while drilling assembly.

4. The method of claim 3, wherein the measurement while drilling assembly further comprises a transmitter, and the method further comprises transmitting the measurement from the sensor using the transmitter.

5. The method of claim 4, wherein transmitting the measurement to the surface comprises using one or more of mud pulse telemetry, electromagnetic telemetry, acoustic telemetry, wired drill pipe, or a combination thereof.

6. The method of claim 4, wherein transmitting the measurement using the transmitter comprises transmitting the measurement to the surface.

7. The method of claim 6, further comprising:

filtering the measurement with one or more of a digital band-pass, analog band-pass, digital high-pass, analog high-pass filter, or a combination thereof; and transmitting the filtered measurement to the surface using the transmitter.

8. The method of claim 7, further comprising geo-steering the bottomhole assembly based on the filtered measurement.

9. The method of claim 4, wherein transmitting the measurement using the transmitter comprises transmitting the measurement to another tool positioned on the drill string.

10. The method of claim 1, further comprising positioning a sensor in at least one of the bearing mandrel, transmission shaft, rotor, or communications package.

11. The method of claim 1, wherein the sensor is one of a low-g accelerometer, a high-g accelerometer, a temperature sensor, a solid-state gyro, a gyroscope, a Hall-effect sensor, a magnetometer, a strain gauge, a pressure transducer or a combination thereof.

12. The method of claim 11, further comprising determining one or more geomechanics parameters from the measurements of the sensor.

13. The method of claim 12, further comprising transmitting the one or more geomechanics parameters to the surface.

14. The method of claim 13, further comprising geo-steering the bottomhole assembly based on the geomechanics parameters.

15. The method of claim 12, further comprising:

determining a severity level corresponding to a measured downhole parameter; and transmitting the severity level to the surface.

16. The method of claim 15, wherein measured downhole parameter is a rock mechanics parameter.

17. The method of claim 15, wherein the measured downhole parameter is high-frequency torsional oscillation, and wherein the method further comprises:

measuring tangential acceleration or angular acceleration with the sensor, the sensor being a tangential accelerometer or gyro;

applying a digital band-pass, analog band-pass, digital high-pass, analog high-pass filter or a combination thereof to the measured tangential acceleration or angular accelerations to generate a filtered acceleration; and coding the filtered acceleration according to predetermined severity level thresholds to determine the severity level.

18. The method of claim 11, further comprising determining one or more pseudo LWD (logging-while-drilling) parameters from the measurements of the sensor.

19. The method of claim 18, further comprising transmitting the one or more pseudo LWD parameters to the surface.

20. The method of claim 19, further comprising geo-steering the bottomhole assembly based on the pseudo LWD parameters.

* * * * *